United States Patent [19]

Yoshida

[11] Patent Number: 4,536,093

[45] Date of Patent: Aug. 20, 1985

[54] ELECTRONIC TIMEPIECE WITH SYSTEM FOR SYNCHRONIZING HANDS

[75] Inventor: Masaru Yoshida, Tanashi, Japan

[73] Assignee: Citizen Watch Company Limited, Tokyo, Japan

[21] Appl. No.: 544,741

[22] Filed: Oct. 24, 1983

[30] Foreign Application Priority Data

Oct. 29, 1982 [JP] Japan ..... 57-190494

[51] Int. Cl.[3] ..... G04B 17/12

[52] U.S. Cl. ..... 368/187; 368/185; 368/157

[58] Field of Search ..... 368/76, 80, 88, 155, 368/157, 160, 220, 200–202, 74, 187–189

[56] References Cited

U.S. PATENT DOCUMENTS

| | | | |
|---|---|---|---|
| 3,967,442 | 7/1976 | Berney | 368/201 |
| 4,266,288 | 5/1981 | Berney | 368/69 |
| 4,358,840 | 11/1982 | Ono et al. | 368/74 |
| 4,433,918 | 2/1984 | Nishimura et al. | 368/220 |

*Primary Examiner*—Bernard Roskoski

*Attorney, Agent, or Firm*—Jordan and Hamburg

[57] ABSTRACT

An electronic timepiece having hands incorporates a correction system whereby the user can rapidly and easily check that the operations of the hands are synchronized, and can adjust the state of synchronization if necessary, by initiating an operating mode in which the hands should rotate to indicate a predetermined reference time value. This checking and adjustment can be carried out at any time, irrespective of the current state of timepiece operation.

9 Claims, 4 Drawing Figures

10
12
CONTROL SIGNAL GENERATING CIRCUIT
13
TIMEBASE OSCILLATOR CIRCUIT
14
15
TIMEKEEPING CIRCUIT
16
ALARM MEMORY CIRCUIT
17
ALARM COINCIDENCE DETECTION CIRCUIT
18
BUZZER DRIVE CIRCUIT
20
DIGITAL DISPLAY CONTROL CIRCUIT
23
HANDS DRIVE CONTROL CIRCUIT

ELECTRONIC TIMEPIECE WITH SYSTEM FOR SYNCHRONIZING HANDS

BACKGROUND OF THE INVENTION

The present invention relates to a correction system for synchronizing an analog (i.e. hands) display section and in particular to a correction system for enabling the timepiece user to easily and rapidly confirm and if necessary adjust the state of synchronization between the content of a hand position memory circuit and the hands display section, without regard to the count state of the timepiece timekeeping circuit when such confirmation and adjustment are carried out.

A loss of synchronization between the content of the hand position memory circuit and the hands display section of such an electronic timepiece can occur for a variety of reasons. It will of course be necessary to initially establish such a state of synchronization when a battery is first inserted into the timepiece, and in general it will be necessary to adjust the operation of hands display section to provide exact synchronization each time the battery is changed thereafter. In addition, there are certain conditions, such as operation at extremely low temperatures, or operation in the vicinity of strong alternating electro-magnetic fields, in which the stepping motor of the timepiece may occasionally fail to rotate correctly in response to drive pulses applied thereto, while the timekeeping circuit continues to operate correctly, so that the time indicated by the hands display section becomes erroneous to some extent.

In the prior art, the hands display of an electronic timepiece has generally been arranged such that the user adjusts it (i.e. sets it into a state of synchronization such as to display a precisely identical time). Such an arrangement is troublesome for the user especially in a case where the electronic timepiece is provided with both analog and digital display capabilities, since if for example the time displayed by the digital display section is known to be accurate or has just been adjusted to an accurate value by the user, then if it is attempted to set the time indicated by the timepiece hands to correspond precisely to that indicated by the digital display section, difficulty will be encountered due to the fact that the time indicated by the digital display section will be constantly changing, in accordance with changes in the count contents of the timepiece timekeeping circuit. It especially desirable to ensure that the time indicated by the hands of such a timepiece corresponds precisely to that indicated by the digital display section, if the timepiece is provided with additional display functions, such as a preset alarm time display function, a stopwatch display function, etc, and if the hands are to be used to indicate time information for one or all of such additional functions. This will be apparent in the case of a timepiece equipped with a stopwatch function, in which both the hands and the digital display section should always start off precisely from an indication representing zero, i.e. the 12:00 position of the hands. Various methods have been proposed for synchronizing the hands display and digital display of an electronic timepiece. One method which has been proposed has been to provide electrical contacts on a part of the wheel train which drives the hands, in order to sense the hands positions electrically. However, the construction of such a timepiece is complex and the configuration is not suitable for providing a very thin and compact wristwatch. In addition, the manufacturing cost is high, and problems arise with regard to reliability of the contacts, and in addition energy is consumed by rubbing against these contacts. For such reasons, such timepieces have not been actually manufactured.

It is an objective of the present invention to provide correction means to enable the information indicated by the timepiece hands display to be easily and accurately set to correspond to the time value of a hand position memory circuit irrespective of the current count state of the timepiece timekeeping circuit. This is accomplished by purely electronic circuit means, which enable the user to instantly check on the state of synchronization between the content of the hand position memory circuit and hands display at any time, and to precisely adjust that state of synchronization in an extremely simple and rapid manner. Such a correction system can be implemented by the addition of a comparatively small number of circuit elements to the timepiece IC chip, so that no significant increase in manufacturing cost will be incurred by incorporation of a system according to the present invention into an electronic timepiece.

SUMMARY OF THE DISCLOSURE

An electronic timepiece equipped with a correction system according to the present invention basically comprises a hands display section including a motor drive circuit, stepping motor and wheel train coupled to the hands, a timebase signal source and a timekeeping circuit coupled to count the timebase signal to thereby provide a count value representing current time information and periodic timekeeping signals, a control signal generating section including externally operable switches, for producing various control signals and correction signals, a hands drive control circuit for controlling the supply of drive signals to produce rotation of the hands, and a hands position memory circuit. When the timepiece is operating such that current time is indicated by the hands display section, the hands position memory circuit stores a count value identical to the count value in the timekeeping circuit representing the current time, and the contents of the hands position memory circuit are successively incremented in synchronism with each drive pulse applied from the hands drive control circuit to rotate the hands. In this condition therefore, the contents of the hands position memory circuit should precisely represent the time indicated by the hands, if the hands display section are operating in synchronization with the content of the hand position memory circuit.

If the user desires to adjust the degree of synchronization between the content of the hand position memory circuit and the hands display section, then the timepiece can be set into a hands position correction mode of operation by actuation of a switch to produce corresponding control signals. Upon initiation of this condition, the hands drive control circuit acts to supply a train of relatively high frequency pulses to drive the hands into rapid rotation and simultaneously to increment the contents of the hands position memory circuit. When the hands position memory circuit contents reach a value corresponding to the reference time value (e.g. a value of zero, for the case of a reference time value of 12:00), then the supply of these high-frequency pulses is terminated. The hands at this point should now be halted indicating the reference time value (e.g. 12:00) if the hands display section is corrected. If this is not so, then the user can actuate a switch to apply correction pulses to drive the hands into positions indicating the reference time value.

When the user now actuates a switch to initiate return from the hands position correction mode to the normal time display mode, then the hands drive control circuit again supplies rapid advancement signal pulses simultaneously to rotate the hands and to increment the contents of the hands position memory circuit, while comparing the contents of the timekeeping circuit and the hands position memory circuit. When the contents of the hands position memory circuit and of the timekeeping circuit reach coincidence, then the supply of rapid advancement signal pulses is halted, and thereafter the hands and the hands position memory circuit contents are periodically advanced by a timekeeping signal.

Such a correction system is extremely simple and convenient for the user. If the hands display section is found to be correctly operated upon establishment of the hands position correction mode, then of course no adjustment need be performed, and the normal time display mode can be immediately re-established.

DESCRIPTION OF THE PREFERRED EMBODIMENT

Figures 1, 1A, 1B:
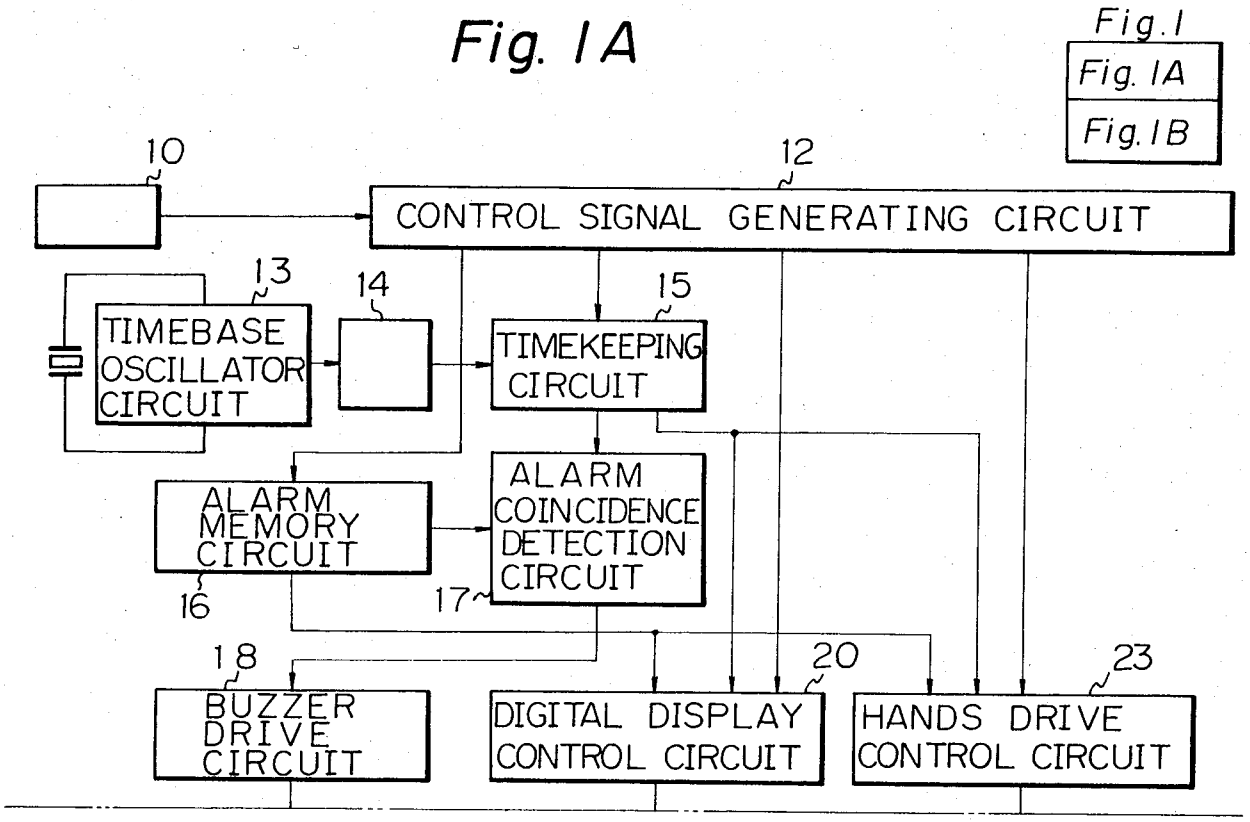
FIGS. 1A, 1B is a block circuit diagram for illustrating the general configuration of an electronic timepiece incorporating a correction system according to the present invention.
Figure 1B:
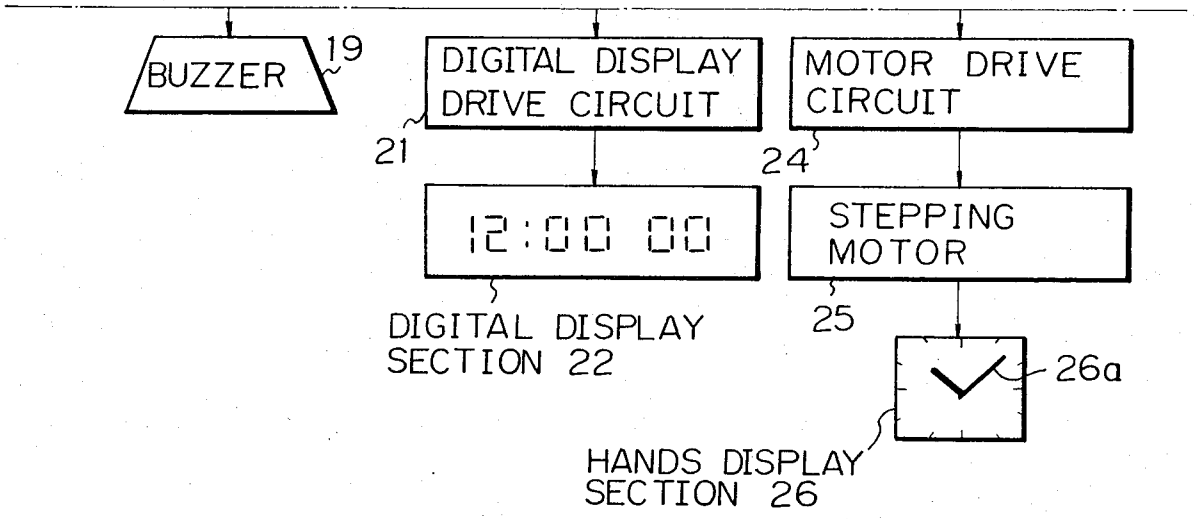

An embodiment of an electronic timepiece incorporating a correction system according to the present invention will now be described, referring to the drawings, with the correction system being shown as being applied to an electronic timepiece provided with both analog and digital display sections. FIG. 1 is a block circuit diagram to show the general configuration of such a timepiece. Numeral 13 denotes a timebase signal source comprising an oscillator circuit which includes a quartz crystal vibrator, numeral 14 denotes a frequency divider circuit, and numeral 15 denotes a timekeeping circuit which serves to count pulses of the timebase signal to thereby provide a count value representing current time information, and to produce a timekeeping signal comprising a periodic pulse train. Numeral 16 denotes an alarm memory circuit for memorizing a preset alarm time. Output signals from alarm memory circuit 16 and timekeeping circuit 15 are coupled to an alarm time coincidence detection circuit 17. When the contents of the alarm memory circuit and of the timekeeping circuit come into coincidence, a buzzer 19 becomes driven by an output signal from a buzzer drive circuit 18.

Numeral 12 denotes a control signal generating section, which produces various control signals, function mode selection signals and correction signals in response to actuations of externally operable switches of a switch group 10 coupled thereto. The function selection signals serve to establish either a current time display state, in which the contents of timekeeping circuit 15 are displayed by electro-optical display section 22 and hands display section 26, or an alarm time display state in which a preset alarm time stored in alarm memory circuit 16 is displayed. The control signals serve to control various circuit operations when changeover is performed between a normal mode and a hands position correction mode of operation, as described in detail hereinafter. The correction signals are used to correct the value of current time which is displayed by electro-optical display section 22, to alter the preset alarm time stored in alarm memory circuit 16, or to adjust the positions of hands 26a with the timepiece in the hands position correction mode to thereby set the electro-optical display section and the hands display section into precise synchronization, as described in detail hereinafter.

A digital display control circuit 20 is coupled to receive output signals from timekeeping circuit 15 representing a count value therein corresponding to current time information, and serves to produce display drive signals which are applied to drive digital display section 22, being output from a digital display drive circuit 21. Digital display section 22 thereby provides a digital display of either the current time or a preset alarm time, as determined by display function control signals applied to digital display control circuit 20 from control signal generating section 12. Numeral 23 denotes a hands drive control circuit which is coupled to receive periodically repetitive timekeeping signals from timekeeping circuit 15 and signals representing the contents of alarm memory circuit 16, and produces drive input signals which are applied through a motor drive circuit 24 to drive a stepping motor 25. The stepping motor 25 is coupled by a wheel train to hands display section 26, to thereby rotate the hands 26a of hands display section 26 to display the current time or a preset alarm time, corresponding to the current time or preset alarm time information displayed by digital display section 22. The stepping motor 25, motor drive circuit 14 and the wheel train collectively constitute hands advancement means for rotating hands 26a, in response to drive input signals from hands drive control circuit 23.

The correction system of this embodiment of the present invention will now be described, referring to the circuit diagram of in FIG. 2. It should be noted that only those portions of the block diagram of FIG. 1 which are essential for understanding of the operation of this correction system are shown in FIG. 1. Thus, the means whereby correction signals are input to the alarm memory circuit, the alarm time coincidence detection circuit, the buzzer drive circuit etc have been omitted from FIG. 2, for clarity in describing the correction system.

In the following description, the designation "12:00" should be taken as denoting an indicated time of 12 hours 0 minutes, (which of course will also correspond to zero seconds) or a count value which corresponds thereto.

The switch group 10 comprises a function mode selection switch S1, a correction mode switch S2, and a correction switch S3. Control signal generating circuit 12, which is essentially a switch input control circuit, is configured of a display mode selection shift register 12a, for selecting the display mode of digital display section 22, a correction mode selection shit register 12b, and AND gates 12c to 12h. In response to successive actuations of function mode selection switch S1, the display mode selection shift register 12a successively and alternately changes over between the logic states 1 0 (as illustrated in FIG. 2) and 0 1, thereby acting to select the current time display mode and the preset alarm time display mode of digital display section 22. When shift register 12a is in the 1 0 state, i.e. when the current time display mode has been selected, then generation of input signals by actuating correction mode switch S2 will produce signals which are transferred through AND gate 12g and thereby input to correction mode selection shift register 12b, so that the information displayed by electro-optical display section 22 can be corrected if required. In addition, both electro-optical display section 22 and hands display section 26 will indicate the current time. When shift register 12a is in the 0 1 state, then AND gate 12g is inhibited, and the contents of alarm memory circuit 16 can be altered as required (by circuit means omitted from FIG. 2, for clarity of description).

The configuration of hands drive control circuit 23 is as follos. A one-shot (i.e. monostable) circuit 23a is coupled to the set terminal of a SR-FF 23b, whose Q output controls the transfer of a 128 Hz pulse signal through an AND gate 23c. An inverter 23d is coupled through an OR gate 23s to a one-shot circuit 23e, whose output is applied to the set terminal of an SR-FF 23f. The Q output of SR-FF 23f controls the transfer of a 128 Hz pulse signal through an AND gate 23g. The output of an OR gate 23t is coupled to an inverting input of an AND gate 23h. The outputs of AND gates 23c, 23g and 23h are input to an OR gate 23i, whose output is input to an OR gate 23j. Output signals from OR gate 23j are applied as drive input signals to motor drive circuit 24.

Although indicated as ordinary AND gates for simplicity of description, numerals 23p and 23g each actually denote a group of AND gates, with gate group 23g being controlled by an output signal from one stage of a 2-stage shift register (or bistable circuit) 23n, as shown in the drawing, and gate group 23p being controlled by the output signal from the other stage of shift register 23n. The outputs of gate groups 23p and 23g are input to a group of OR gates 23r, and the outputs of OR gate group 23r are input to one side of a coincidence detection circuit 23k. The count contents of timekeeping circuit 15 are applied as a set of parallel signals to inputs of gate group 23p, while the count contents of alarm memory circuit 16 are similarly applied to inputs of gate group 23g.

Numeral 23w denotes a hands position memory circuit, whose count contents are identical to the count contents of timekeeping circuit 15 when the timepiece is operating with the current time indicated by both electro-optical display section 22 and hands display section 26, being successively incremented by one each time a drive input pulse is applied from hand drive control circuit 23 to motor drive circuit 24. Numeral 23 denotes a zero detection circuit, which produces a zero detection signal when the contents of hands position memory circuit 23w reach zero, as described hereinafter. An AND gate 23u is controlled to transfer a 4 Hz correction signal to OR gate 23j by the output of AND gate 12 in control signal generating section 12.

In the following description of the operation of shift register 12b and of hands drive control circuit 23, it will be assumed that the timepiece has been set in the current time display mode, as described. above. In this case, the first switch input signal pulse produced by actuating switch S2 will change the state of correction mode selection shift register 12b from the condition 1 0 0 0 0 (illustrated in FIG. 2), for which the timepiece operates in the normal mode, to the condition 0 1 0 0, which is the seconds correction mode. (Here, the term "normal mode" denotes an operating mode in which the electro-optical display section displays the current time, and correction of the displayed time can be initiated.) As a result, AND gate 12c becomes enabled. If correction switch S3 is actuated in this condition, then the resulting switch input signals will be transferred through AND gate 12c to be applied to the reset terminal R of secnds counter sections 14a and 15a of frequency divider circuit 14 and timekeeping circuit 15 respectively. As a result, the units of seconds counts and count values representing less than one second in frequency divider circuit 14 and timekeeping circuit 15 will be reset to zero.

With the timepiece in this seconds correction mode, if switch S2 is once more actuated, then correction mode selection shift register 12b will advance to the condition 0 0 1 0 0, which is the minutes correction mode. AND gate 12d is thereby enabled. If correction switch S3 is actuated in this condition, then the resultant input signals will be transferred through AND gate 12d and applied to the correction signal input terminal of the minutes counter circuit section 15b within timekeeping circuit 15, to thereby perform correction of the minutes time information to a desired value. Hours correction is implemented in a similar manner to the minutes correction, with the state of correction mode selection shift register 12b being advanced to 0 0 0 1 0 so that AND gate 12e is enabled. An output signal from correction mode selection shift register 12b is input to digital display control circuit 20 as a correction mode selection signal, thereby causing the display digits corresponding to the correction mode that is currently selected to be set in a repetitively flashing condition on digital display 22, to thereby provide confirmation of the correction mode.

With correction mode selection shift register 12b in the condition 0 0 0 1 0, i.e. the hours correction mode, then if correction mode switch S2 is actuated, shift register 12b will go to the state 0 0 0 0 1. This is the hands correction mode. In this case, an output signal from correction mode selection shift register 12b is input to digital display control circuit 20 as a correction mode selection signal. As a result, digital display section 22 displays a reference time value, such as 12:00, or 00. This reference time value corresponds to some specific position of the hands of the timepiece, e.g. to a predetermined "zero position" of the hands and is displayed by digital display section 22 in the hands correction mode, irrespective of the contents of timekeeping circuit 15, to thereby indicate that the timepiece is in the hands correction status.

In addition, output line A from correction mode selection shift register 12b (which goes to the high logic level at the instant when the hands position correction mode is entered, and thereafter remains at that level) is coupled to an input of hands drive control circuit 23, a shown in the drawing, so that at the instant when the hands correction mode is selected as described above, a single pulse signal will be output by one-shot circuit 23a. This pulse is applied to the set terminal S of set-reset flip-flop (hereinafter abbreviated to SR-FF) 23b. As a result, the output Q of SR-FF 23b acts to enable AND gate 23c, whereby a signal comprising a pulse train having a repetition rate of 128 Hz (produced from frequency divider circuit 14) is trasferred through AND gate 23c and OR gates 23i and 23j, to be applied as a drive input signal to motor drive circuit 24. The stepping motor 25 is thereby driven into rapid advancement by a drive signal comprising a train of drive pulses having a frequency of 128 Hz. The 128 Hz signal which is output from OR gate 23i is also input to hands position memory circuit 23w. When the count contents of hands position memory circuit 23w reach a value corresponding to the reference time value (which in this embodiment is assumed to be 12:00, with the corresponding count value in timekeeping circuit 5 or in hands position memory circuit 23w being zero) then a zero detection signal is output by zero detection circuit 23m. As a result, SR-FF 23b is reset, so that AND gate 23c becomes inhibited, whereby rapid advancement operation is terminated. Since the same number of pulses that were input to hands position memory circuit 23w to bring the contents thereof to zero where also input to motor drive circuit 24, hands 26a should now have been rotated into positions indicating the reference time value. From the above it can be understood that when the hands correction mode is selected, then the digital display section is controlled such as to display the reference time value, while in addition the hands are rapidly advanced to positions which should also indicate the reference time value.

On completion of this rapid advancement operation, the hands are halted and the timepiece enters a hands correction waiting state. If it is assumed that the electro-optical display section and hands display section were operating correctly in synchronism before the hands position correction mode was entered, i.e. that the time indicated by the hands display section corresponded with the count contents of hands position memory circuit 23w, and hence was precisely identical to that indicated by the electrooptical display section, then when stepping motor 25 is halted with the timepiece in the hands correction waiting state, the hands display section 26 will display precisely the same reference time value that is indicated by digital display section 22. That is to say, if the reference time value is 12 o-clock, i.e. 12:00, then hands 26a will be halted in the 12 o-clock position. However if for some reason, (such as battery changeover having been carried out) the digital display section and the hands display section are not synchronized, then the hands will not indicate the reference time value when the timepiece enters the hands correction waiting state. In this case, the hands positions can be adjusted to indicate the reference time value appearing on digital display section 22 (e.g. 12:00 or 00), by actuations of corrections switch S3.

In other words, since SR-FF 23b is in the reset state in this hands correction waiting state, so that the Q output thereof is at the high logic level, and since output line A from shift register 12b is at the high logic level, AND gate 12f becomes enabled. Thus, when switch S3 is actuated, the output of AND gate 12f will go to the high logic level, to thereby enable AND gate 23u. Thus, so long as switch S3 is held actuated, a signal comprising a pulse train at a frequency of 4 Hz signal (produced by frequency divider circuit 14) is transferred through AND gate 23u and OR gate 23j to be input as a correction signal to motor drive circuit 24. As a result, stepping motor 25 is driven by drive signal pulses at a frequency of 4 Hz. In this way, 26a can be rotated as required towards the reference time value indicating positions by actuating switch S3.

This 4 Hz correction signal is not input to the hands position memory circuit 23w, so that the contents of hands position memory circuit 23w remain unchanged at the reference time value while this correction operation is in progress.

In this way, the timepiece user can easily and rapidly adjust the positions of hands 26a in hands display section 26 to indicate the reference time value that is being displayed by digital display section 22.

In this embodiment of the present invention, the hands correction mode is provided as one of the corection modes that can be selected by utilizing correction mode selection shift register 12b. However it is of course equally possible to provide circuit means for controlling initiation and termination of the hands position correction mode which are separate from the correction signal control circuits. To summarize the above, when the hands position correction mode is initiated, the hands are rapidly advanced to the reference time value positions by arranging that the contents of the hands position memory circuit 23w are rapidly incremented by a rapid advancement signal, in synchronism with advancement of the hands by that signal, until the hands position memory circuit contents reach a count value corresponding to the reference time value. The hands correction waiting state is then entered, and thereafter th hands positions can be easily corrected if necessary to precisely indicate the reference time value, by actuating correction switch S3.

The advantages of such an arrangement, and in particular the advantages of selecting the 12:00 (i.e. 12 o-clock) time as the reference time value, are as follows:

1. Generally speaking, the timepiece hands are positioned at the 12:00 position when they are attached to the timepiece during assembly operations, and it is undesirable to set the hands to other positions, due to such factors as inaccuracies in the positions of the graduations printed on the dial plate at other time indication positions.

2. In the case of a timepiece which has a polygonal shape of dial plate, the dial markings may be substantially separated from the tips of the hands at time positions other than the 12:00 position, making it difficult to set the hands precisely at other positions.

3. Since the positions of the hands can be set with the digital display section halted in a condition indicating the reference time value, it is very easy to set the hands positions while the timekeeping circuit continues to perform timekeeping operation.

It will be apparent that when the hands position correction mode is entered and the hands are rapidly rotated until the contents of hands position memory circuit 23w reach the reference time value, then if hands display section 26 indicates the reference time value precisely at that point, it will not be necessary to actuate correction switch S3 to perform adjustment of the hands positions. In other words, if it is only desired to confirm that the time indicated by hands display section 26 and the contents of the hands position memory circuit 23w are synchronized, then there is no need to actuate switch S3 to perform repositioning of the hands, and the user can immediately return the timepiece to the normal operating mode.

The hands position correction mode (with shift register 12b is in the condition 0 0 0 0 1) can be terminated by once more actuating correction mode switch S2. When this is done, shift register 12b will return to the 1 0 0 0 0 state, i.e. to the normal mode. When this occurs, then output line A from shift register 12b will change from the high to the low logic level, whereby the output signals from inverter 23d and therefore of OR gate 23s will change from the low to the high logic level. As a result, a single pulse signal will be output by one-shot circuit 23e. This signal acts to set SR-FF 23f, and as a result the Q output of SR-FF 23f goes to the high logic level, so that AND gate 23g becomes enabled. The 128 Hz rapid advancement signal pulses are thereby transferred through AND gate 23g, and through OR gates 23i and 23j, to be input to motor drive circuit 24. The stepping motor 25 is thereby driven so that hands 26a are rapidly advanced. In addition, these 128 Hz rapid advancement signal pulses are applied from the output of OR gates 23i to an input of hands position memory circuit 23w. As described in the above, hands position memory circuit 23w has been previously set to a count of zero (assuming that a count value of zero corresponds to the reference time value) when the hands correction waiting state was entered, and has thereafter been left in this zero count state. Hands position memory circuit 23w now begins to be incremented by the rapid advancement signal pulses, and when the count value therein reaches a value which coincides with the count contents of timekeeping circuit 15 then a coincidence signal is output by hands drive coincidence detection circuit 23k. This coincidence signal is applied to the reset terminal R of SR-FF 23f, which is thereby reset. AND gate 23g thereby becomes inhibited, so that transfer of rapid advancement signal pulses is terminated.

The condition of hands display mode selection shift register 23n serves to determine whether hands drive coincidence detection circuit 23k acts to detect coincidence between the contents of timekeeping circuit 15 and the contents of hands position memory circuit 23w. In this condition, correction switch S3 is also used to select the display mode of hands display section 26, i.e. the state of hands display mode selection shift register 23n can be changed by actuation of correction switch S3 to designate either that the contents of alarm time memory circuit 16 (i.e. the preset alarm time) or the contents of timekeeping circuit 15 (i.e. the current time, appearing on electro-optical display section 22) will be displayed by hands display section 26. Such changeover of the display contents of hands display section 26 can only be carried out when correction mode selection shift register 12b is operating in the normal state (i.e. the state 1 0 0 0 0) so that AND gate 12h is in the enabled state. In this case, signals produced by actuation of correction switch S3 are transferred through AND gate 12h and input to hands display mode selection shift register 23n. If shift register 23n is in the state 1 0, with the current time display mode selected, then the count contents of timekeeping circuit 15 will be transferred through AND gate group 23p and OR gate group 23r, and hence input to hands drive coincidence detection circuit 23k. Conversely, if shift register 23f is in the state 0 1, i.e. with the timepiece in the alarm set display mode, then the contents of alarm memory circuit 16 will be transferred through AND gate group 23q and OR gate group 23r, and hence input to hands drive coincidence detection circuit 23k. If for example the timepiece is in the current time display mode, then if correction switch S3 is actuated, the resultant output signal will be applied through AND gate 12h to OR gate 23s and also to shift register 23n. As a result, shift register 23n will change to the 0 1 state, thereby designating display of the preset alarm time by hands display section 26. In addition, the signals produced by actuation of switch S3 are also transferred from AND gate 12h through OR gate 23s to be input to one-shot circuit 23e. As a result, a single pulse signal is produced by one-shot circuit 23e, which is applied to the set terminal S of SR-FF 23f. The SR-FF 23f thereby is set, wereby AND gate 23g becomes enabled, and the 128 Hz rapid advancement signal pulses are transferred through AND gate 23g an OR gate 23i and 23j, to be input to motor drive circuit 24. Motor 25 is thereby driven into rapid advancement. At the same time, the rapid advancement signal pulses from the output of OR gate 23i are input to hands position memory circuit 23w, and counted by that circuit. When coincidence is detected between the contents of hands position memory circuit 23w and the contents of alarm memory circuit 16, then a coincidence detection signal is output by coincidence detection circuit 23k, and is applied to the reset terminal of SR-FF 23f. As a result, SR-FF 23f is reset, and the logic states of its output signals are thereby inverted, so that AND gate 23g is returned to the inhibited state. The rapid advancement drive operation is thereby terminated with the preset alarm time being indicated by hands display section 16. It can thus be understood that with the timepiece in the normal mode, actuation of correction switch S3 will provide selective changeover between displaying the count contents of timekeeping circuit 15 and the count contents of alarm memory circuit 16, by hands display section 26.

When correction mode selection shift register 12b is in the state 0 0 0 0 1, i.e. with the hands correction mode being selected, then if hands display mode selection shift register 23n is in the state 0 1 (i.e. with the preset alarm time being displayed by hands display section 26), the output from OR gate 23t will be at the low logic level so that AND gate 23h is inhibited. As a result, the normal timekeeping hands drive signal $\emptyset$ from frequency divider circuit 14 will not be transferred through AND gate 23h. At all other times, when the output from OR gate 23t is at tht high logic level, AND gate 23h is enabled so that timekeeping signal $\emptyset$ is transferred through AND gate 23h and through OR gates 23i and 23j, to be input to motor drive circuit 24. Motor 25 is thereby periodically stepped, thereby advancing hands display section 26 to display the current time. In this condition, since timekeeping signal $\emptyset$ is applied from the output of OR gate 23i to the input of hands position memory circuit 23w, the time which is displayed by hands display section 26 and the contents of hands position memory circuit 23w will be held continuously in synchronism with one another.

Figure 2A:
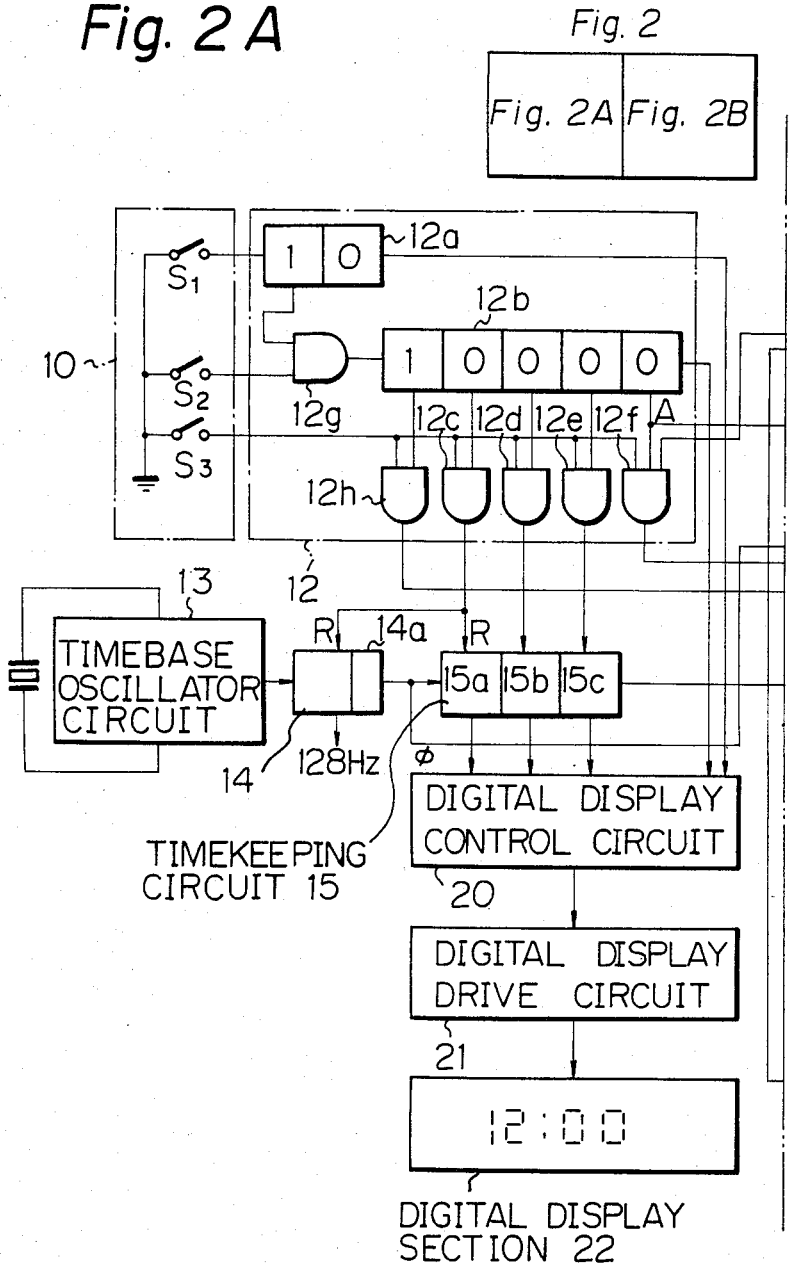
FIGS. 2A, 2B is a simplified circuit diagram for assistance in describing the correction system of the embodiment of FIG. 1.
Figure 2B:
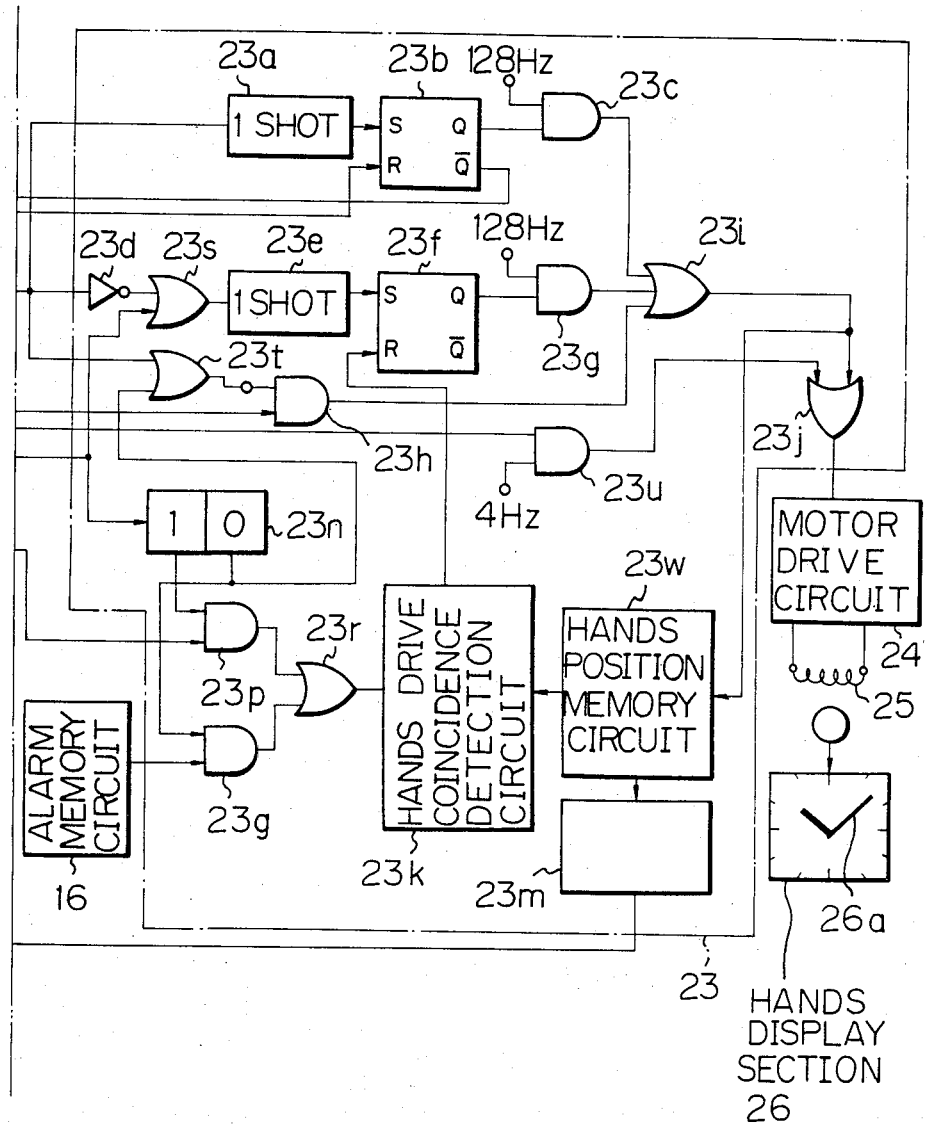

It should be noted that although in the block diagram of FIG. 1, an alarm coincidence detection circuit 17 is shown as being separated from hands drive control circuit 23, it would be equally possible to utilize coincidence circuit 23k shown in FIG. 2 both for alarm time coincidence detection and for hands position coincidence detection purposes, by simple circuit modifications.

The basic advantages of the present invention are as follows. Firstly setting of the timepiece hands to match the time indicated by the digital display section, following initial insertion of a battery in the timepiece or after each battery change, can be easily and accurately carried out.

Furthermore, due to the incorporation of a hands position memory circuit, the data which is displayed by the digital display section in any of a number of different function modes (i.e. data representing a count value or memory contents) can be easily displayed by the hands display section. Such functions include for example a dual time function, a preset alarm time setting function, a stopwatch (i.e. elapsed time) function, a timer (i.e. remaining time) function, etc.

In addition, by comparison with an analog/digital timepiece in which the displays are synchronized by an arrangement incorporating contact points, a system according to the present invention does not apply any mechanical load on the wheel train, and adjustment of the hands positions after attachment of the hands can be easily carried out. Thus, the manufacturing costs of a timepiece according to the present invention can be substantially lower than is possible with the prior art.

Another advantage is that if the timepiece should be set into the hands correction mode by accident, then it can be easily returned to the normal operating mode without any loss of synchronization between the time indicated by the hands and the contents of the hands position memory circuit (and hence no loss of synchronization with the time indicated by the digital display section).

Although the present invention has been described in the above with reference to a specific embodiment, it should be noted that various changes and modifications to the embodiment may be envisaged, which fall within the scope claimed for the invention as set out in the appended claims. The above specification should therefore be interpreted in a descriptive and not in a limiting sense.

What is claimed is:

1. An electronic timepiece, comprising:

timekeeping circuit means comprising a timebase signal source and counter circuit means for counting said timebase signal to produce a count value representing current information and a timekeeping signal comprising a pulse train;

control signal generating means comprising externally operable mode selecting switch means for producing a plurality of control signals including control signals for selectively establishing a normal mode and a hands position correction mode of operation, and externally operable correction switch means for producing correction signals;

hands display means comprising time indicating hands and hands advancement means for rotating said hands;

hands drive control circuit means responsive to said control signals and said timekeeping signal in said normal mode for periodically applying drive input signal pulses to said hands advancement means for advancing said hands to thereby indicate time information, and comprising hands position memory circuit means for storing a count value which is periodically incremented by said drive input signal pulses during said normal mode, circuit means acting upon initiation of said hands position correction mode for applying rapid advancement signal pulses simultaneously to said hands advancement means and said hands position memory circuit means, reference time value detection circuit means coupled to said hands position memory circuit means for detecting when the count therein reaches a reference time value and responsive to said detection for acting to terminate application of said rapid advancement signal pulses to said hands advancement means and hands position memory circuit means, said hands advancement means being thereafter responsive to said correction signals for enabling setting of said hands to indicate said reference time value, said hands drive control circuit means being responsive to changeover from said hands position correction mode to said normal mode for applying said rapid advancement signal pulses simultaneously to said hands advancement means and hands position memory circuit means and moreover comprising coincidence detection means operable following the latter changeover for comparing the count value in said hands position memory circuit means with said count value in said timekeeping circuit means and responsive to coincidence being reached therebetween for terminating application of said rapid advancement signal pulses to said hands advancement means and hands position memory circuit means, said hands drive control circuit means acting thereafter to apply said timekeeping signal simultaneously to said hands advancement means and hands position memory circuit means to thereby synchronously update the count value in said hands position memory circuit means and the time displayed by said hands while maintaining said count value in correspondence with said displayed time.

2. An electronic timepiece according to claim 1, in which said reference time value detection circuit means generates a reference time value detection signal when the count value in said hands position memory circuit means reaches coincidence with said reference time value and in which said coincidence detection means generate a coincidence detection signal when the count value in said timekeeping circuit means reaches coincidence with the count value in said hands position memory circuit means, and in which said hands drive control circuit means further comprise:

first gate means controlled by said reference time value detection signal and said control signals for applying said rapid advancement signal pulses to said hands advancement means and hands position memory circuit means upon initiation of said hands position correction mode until said reference time value count value is reached by said hands position memory circuit means;

second gate means controlled by said coincidence detection signal and said control signals for applying said rapid advancement signal pulses to said hands advancement means and hands position memory circuit means upon termination of said hands position correction mode until the count value in said hands position memory circuit means attains coincidence with the count value in said timekeeping circuit means.

3. An electronic timepiece according to claim 2, in which said first gate means comprise:

first bistable circuit means controlled by said reference time value detection signal and by one of said control signals which is generated at the instant of initiation of said hands position correction mode, and;

first gate circuit means controlled by output signals from said first bistable circuit means for selectively enabling and inhibiting transfer of a relatively high frequency pulse train produced by said timekeeping circuit means to said hands advancement means as said rapid advancement signal pulses;

said first gate circuit means being enabled to transfer said rapid advancement signal pulses when said first bistable circuit means are set in a first logic state by said control signal and being subsequently inhibited from transferring said rapid advancement signal pulses when said first bistable circuit means are reset to a second logic state by said reference time value detection signal.

4. An electronic timepiece according to claim 3, in which said second gate means comprise:

second bistable circuit means controlled by said coincidence detection signal and by one of said control signals generated at the instant of termination of said hands position correction mode, and;

second gate circuit means controlled by output signals from said second bistable circuit means for selectively enabling and inhibiting transfer of said relatively high frequency pulse train to said hands advancement means as said rapid advancement signal pulses;

said second gate circuit means being enabled to transfer said rapid advancement signal pulses when said second bistable circuit means are set in a first logic state by said control signal and being subsequently inhibited from transferring said rapid advancement signal pulses when said second bistable circuit means are reset to a second logic state by said coincidence detection signal.

5. An electronic timepiece according to claim 2, in which said electronic timepiece is provided with an alarm function in addition to a current time display function.

6. An electronic timepiece according to claim 5, in which said control signal generating means are operable by switch actuation during said normal mode to produce function mode selection signals for selectively designating a current time mode of operation in which currect time is displayed by said hands display means and said alarm time mode, in which a preset alarm time is displayed by said hands display means, and further comprising:

alarm memory circuit means for storing a count value representing a preset alarm time;

changeover gate circuit means responsive to said function mode selection signal designating said current time mode for applying the contents of said timekeeping circuit means to said coincidence detection means to be compared with the contents of said hands position memory circuit means, and responsive to said function mode selection signal designating said alarm time mode for applying the contents of said alarm time memory circuit means to said coincidence detection means to be compared with the contents of said alarm memory circuit means;

said second gate means being responsive to said function mode selection signals initiating said current time mode and said alarm time mode respectively for initiating application of said rapid advancement signal pulses to said hands advancement means to rapidly advance said hands and also to said hands position memory circuit means to increment the count value therein, and being further responsive to said coincidence detection signal from said coincidence detection means for terminating application of said rapid advancement signal pulses;

whereby said hands are rapidly rotated into position indicating said current time following changeover from said alarm time mode to said current time mode, and are rapidly rotated into positions indicating said preset alarm time following changeover from said current time mode to said alarm time mode.

7. An electronic timepiece according to claim 1, in which said hands advancement means comprise:

a motor drive circuit coupled to receive said drive input signals from said hands drive control circuit means;

a stepping motor coupled to receive motor drive signals produced by said motor drive circuit; and a wheel train coupled between said stepping motor and said hands.

8. An electronic timepiece according to claim 1, and further comprising electro-optical display means coupled to said timekeeping circuit means during operation in said normal mode for displaying said time information in digital form.

9. An electronic timepiece according to claim 8, in which said electro-optical display means are moreover controlled by said control signals during operation in said hands position correction mode to display said reference time value in digital form.

* * * * *